US008390503B2

(12) United States Patent
Shigei

(10) Patent No.: US 8,390,503 B2
(45) Date of Patent: Mar. 5, 2013

(54) REMOTE CONTROLLER AND REMOTE CONTROL SYSTEM

(75) Inventor: Hiroyuki Shigei, Tokyo (JP)

(73) Assignee: Sony Corporation, Tokyo (JP)

( * ) Notice: Subject to any disclaimer, the term of this patent is extended or adjusted under 35 U.S.C. 154(b) by 360 days.

(21) Appl. No.: 12/717,353

(22) Filed: Mar. 4, 2010

(65) Prior Publication Data

US 2010/0231432 A1 Sep. 16, 2010

(30) Foreign Application Priority Data

Mar. 13, 2009 (JP) ..... P2009-061204

(51) Int. Cl.
*G08C 19/12* (2006.01)

(52) U.S. Cl. ..... 341/176; 455/419

(58) Field of Classification Search ..... 455/419, 455/420; 341/176; 340/309.16
See application file for complete search history.

(56) References Cited

U.S. PATENT DOCUMENTS 6,622,018 B1 * 9/2003 Erekson ..... 455/420
7,777,642 B2 * 8/2010 Kim et al. ..... 340/12.52
8,077,016 B2 * 12/2011 Cohen ..... 340/309.16
8,160,120 B2 * 4/2012 Ineichen et al. ..... 375/132
2008/0313299 A1 12/2008 Ebbe et al.
2009/0058681 A1 3/2009 Johnston et al.

FOREIGN PATENT DOCUMENTS

JP 2005-117120 4/2005
JP 2005-198115 7/2005
JP 2005-2536340 9/2005
JP 2006-222863 8/2006

OTHER PUBLICATIONS

Notification of Search Report from the European Patent Office mailed May 7, 2012, for European Patent Application No. 10/250,403.2.
Japanese Office Action for 2009-061204, Mailed Oct. 16, 2012. 3 pgs.

* cited by examiner

*Primary Examiner* — Brian Young
(74) *Attorney, Agent, or Firm* — Finnegan Henderson Farabow Garrett & Dunner LLP

(57) ABSTRACT

A remote control method includes: grouping a plurality of apparatuses to respond to a command from a single remote controller at the same time; broadcasting, by the remote controller, a command corresponding to an operation; receiving, by each of the plurality of apparatuses, the command and judging whether the received command is addressed to a group to which the apparatus itself belongs; and executing, when it is judged by each of the plurality of apparatuses that the received command is addressed to the apparatus itself, processing corresponding to the command.

11 Claims, 8 Drawing Sheets

REMOTE CONTROLLER AND REMOTE CONTROL SYSTEM

BACKGROUND OF THE INVENTION

1. Field of the Invention

The present invention relates to a remote controller and a remote control system capable of remotely controlling a plurality of apparatuses that are wirelessly connected to one another.

2. Description of the Related Art

In recent years, it has become possible to hang video display panels such as a liquid crystal display apparatus and an organic EL (Electroluminescence) panel (hereinafter, referred to as display unit) on walls in houses due to thinning and a reduction in weight of the display unit. However, a cable extending from the display unit hung on the wall impairs an appearance to thus cause a restriction of an installation location. A technique of transmitting necessary video signals and the like to the display panel from another apparatus (hereinafter, referred to as media receiver unit) without using a cable is already in practical use.

It is desirable to use a single remote controller for operating two apparatuses of the display unit and the media receiver unit. This type of remote controller is called multi-remote controller. There are known two methods of controlling a plurality of apparatuses by a remote controller. As an example, let us assume an operation of turning on a power source of the apparatuses. In the first method, a power-ON command from a remote controller is received by one apparatus such as a display unit, and the power-ON command is transferred from the display unit to another apparatus such as a media receiver unit.

In the second method, after an operation of switching an apparatus to be controlled is carried out in a remote controller, a command is transmitted to the selected apparatus. The remote controller itself may successively issue a command to the apparatuses without carrying out the switching operation. Japanese Patent Application Laid-open No. 2005-198115 describes an example of a multi-remote controller.

SUMMARY OF THE INVENTION

The first method has a problem that it takes time for the display unit as a control-source apparatus to start controlling the media receiver unit as another apparatus and a time required for the power source to be turned on is thus prolonged. The display unit is normally conductive only at a light-receiving portion that receives transmission light from the remote controller and is not conductive at a wireless connection portion wirelessly connected to the media receiver unit. Therefore, when a power-ON command is received from the remote controller, the wireless connection portion of the apparatus itself needs to be energized and initial processing needs to be carried out first to enable communication to be performed with the media receiver unit. As a result, a time required for the power source of the media receiver unit to be turned on is prolonged, with the result that a wait time that is required for a user to receive a service is prolonged. By energizing the wireless connection portion and carrying out the initial processing in advance, it may be possible to avoid the problems described above. However, a problem that power consumption during standby increases arises.

The media receiver unit on a side that does not receive a command from the remote controller needs to constantly supply power to a portion that performs a wireless connection with respect to the display unit. Since the wireless connection between the display unit and the media receiver unit is used in transmitting a video signal, an audio signal, and the like, problems that power consumption is larger than that of a connection portion with respect to the remote controller and power consumption during standby increases arise.

In the second method, the operation of switching the apparatus to be controlled is added, and an operability thus becomes poorer. When switching the control target by a sequence of the remote controller itself, software on the remote controller side becomes complex.

Therefore, there is a need for a remote controller and a remote control system capable of solving the problems described above.

According to an embodiment of the present invention, there is provided a remote control method including: grouping a plurality of apparatuses to respond to a command from a single remote controller at the same time; broadcasting, by the remote controller, a command corresponding to an operation; receiving, by each of the plurality of apparatuses, the command and judging whether the received command is addressed to a group to which the apparatus itself belongs; and executing, when it is judged by each of the plurality of apparatuses that the received command is addressed to the apparatus itself, processing corresponding to the command.

According to another embodiment of the present invention, there is provided a remote control system including: a single remote controller including an operation portion and a communication portion that broadcasts a command corresponding to an operation made to the operation portion; and a plurality of apparatuses grouped to respond to the command from the remote controller at the same time, each of the plurality of apparatuses including a reception judgment portion that receives the command and judges whether the received command is addressed to a group to which the apparatus itself belongs and a controller that executes, when it is judged that the received command is addressed to the apparatus itself, processing corresponding to the command.

According to the embodiments of the present invention, it is possible to shorten a time required for processing to end since a user has operated a remote controller. Particularly an effect of shortening a time required for a power source to be actually turned on since having received a power-ON command is large. In addition, power consumption during standby can be reduced. Moreover, a user operation using a remote controller and sequence processing of the remote controller can be simplified.

These and other objects, features and advantages of the present invention will become more apparent in light of the following detailed description of best mode embodiments thereof, as illustrated in the accompanying drawings.

DESCRIPTION OF PREFERRED EMBODIMENTS

Hereinafter, an embodiment of the present invention will be described with reference to the drawings.

It should be noted that the embodiment described below is a specific favorable example of the invention and various technically-favorable limitations are placed thereon. However, the technical range of the present invention is not limited to the embodiment unless specifically stated otherwise in descriptions below.

<Embodiment>

(Outline of System)

Figure 1:
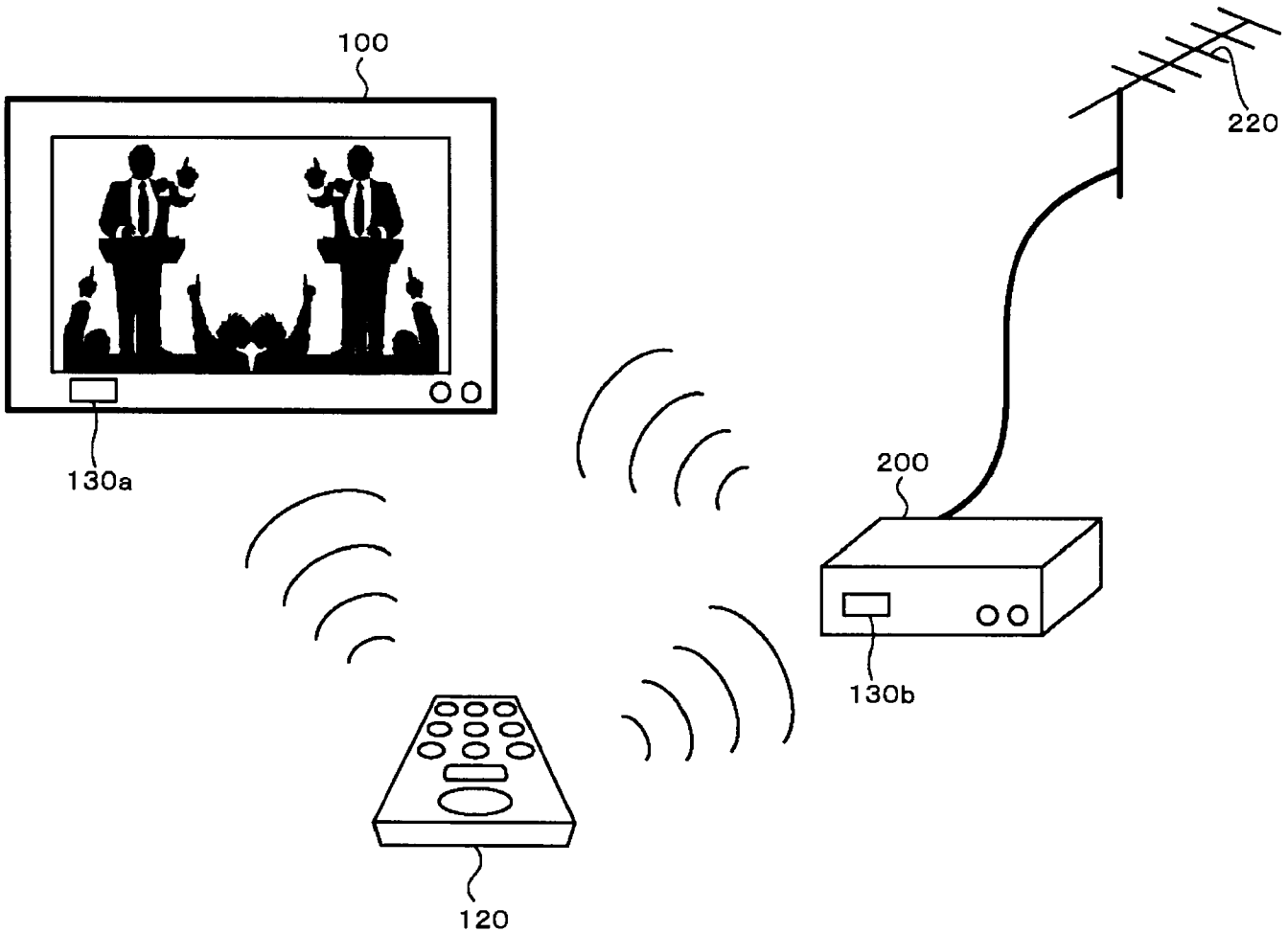
FIG. 1 is a block diagram showing a schematic structure of a system according to an embodiment of the present invention.

As shown in FIG. 1, the embodiment is constituted of a display unit 100 hung on, for example, a wall in a house and a media receiver unit 200 connected to the display unit 100 via a wireless transmission path.

The display unit 100 includes a display panel such as a liquid crystal display panel and a reception/control apparatus. The reception/control apparatus includes a reception wireless module. The reception wireless module receives video and audio signals from a transmission wireless module of the media receiver unit 200. Using, for example, a 5-GHz band, the video and audio signals are transmitted according to a standard that is based on a wireless LAN of IEEE (Institute of Electrical and Electronics Engineers) 802.11a having a transmission velocity of 54 Mbps.

A transmission/reception IC capable of realizing a data transmission of 1.5 gigabit/sec using a frequency channel of 18 MHz of the 5-GHz band and transmitting a non-compressed 1080i/720p HD (High Definition) television signal can be used. This IC is known as WHDI (Wireless High-Definition Interface (registered trademark)). It should be noted that the present invention is not limited to the transmission system above, and a transmission system that uses a 60-GHz band, a UWB (Ultra Wideband) system, or the like may be used instead. The digital video signal received by the wireless module is supplied to the display panel to be displayed thereon. The digital audio signal received by the wireless module undergoes a stereo reproduction from a speaker.

A remote control signal transmitted from a remote controller 120 is transmitted via a wireless transmission path of a 2.4-GHz band. The remote control signal from the remote controller 120 is received by reception apparatuses (hereinafter, referred to as reception modules as appropriate) 130*a* and 130*b* of the display unit 100 and the media receiver unit 200, respectively. The received remote control signal is supplied to a controller of each unit. As a signal format that supports a command, there is, for example, a format that is the same as that of an existing infrared-ray remote controller.

Similar to a commander with respect to a normal television receiver, the remote controller 120 includes a power ON/OFF key, a channel switch key, a volume control key, an input video signal switching switch, keys for GUIs, and the like.

A television antenna 220 is connected to the media receiver unit 200 so as to enable the media receiver unit 200 to receive television broadcasts. There is also a case where an external video signal source is connected to the media receiver unit 200. Received video and audio signals of a television broadcast program are supplied to the wireless module. The wireless module wirelessly transmits the video and audio signals to the wireless module of the display unit 100 using the 5-GHz band without compressing the signals. The media receiver unit 200 includes operation keys. In addition, an operation of the media receiver unit 200 is controlled by the remote control signal received via the reception module 130*b*.

(Remote Control System)

Figure 2A:
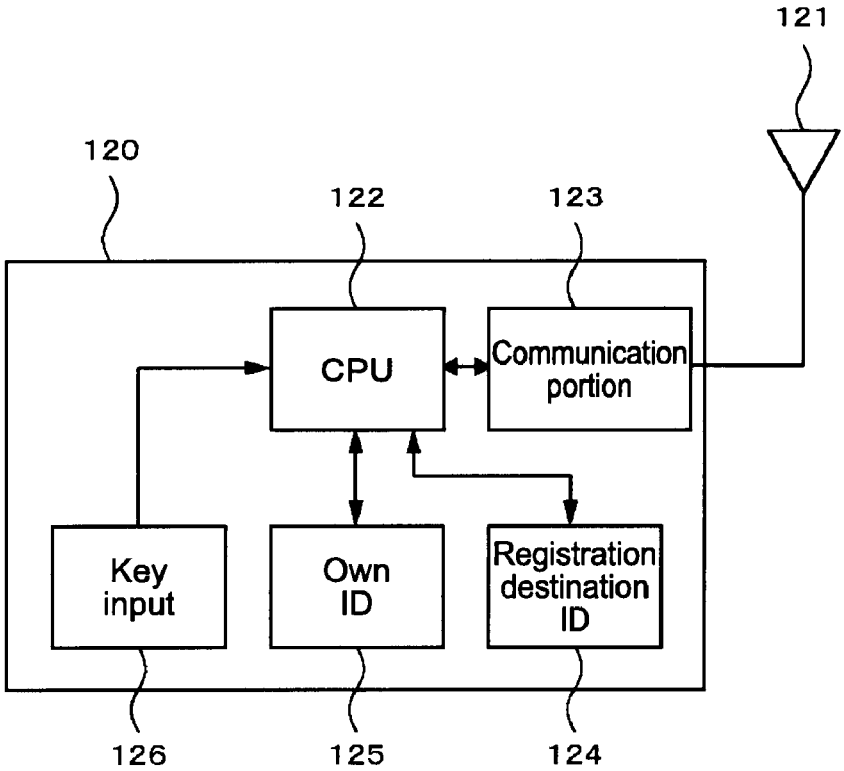
FIG. 2 are block diagrams respectively showing examples of a transmission module of a remote controller and a reception module according to the embodiment of the present invention.

As shown in FIG. 2A, the remote controller 120 includes an antenna 121 for transmitting and receiving wireless radio waves. The remote controller 120 also includes a microprocessor (hereinafter, referred to as CPU (Central Processing Unit)) 122 as a controller for causing a communication function, a read/write operation with respect to a recording medium, and programs corresponding to various key inputs to operate. In addition, the remote controller 120 includes a communication portion 123 for performing wireless communication, a storage medium 124 for storing an identification information ID of a pairing counterpart, a storage medium 125 for storing its own ID, and a key input portion 126 including keys. The storage medium 124 and the storage medium 125 are each constituted of, for example, a writable nonvolatile memory. The CPU 122 includes a ROM (Read Only Memory), a RAM (Random Access Memory), and the like and collectively controls the respective portions of the remote controller 120 by executing programs stored in the ROM and the like.

As identification information, EUI64 (64-bit Extended Unique Identifier) as an ID equivalent to a MAC address can be used, for example. During a pairing operation and a normal communication operation, the identification information is used as transmission source information and transmission destination information. The EUI64 is 64-bit identification information allocated to an interface of a communication apparatus. Apparatuses that respond to a single command from the remote controller 120 at the same time are defined by grouping. A grouping method will be described later.

Figure 2B:
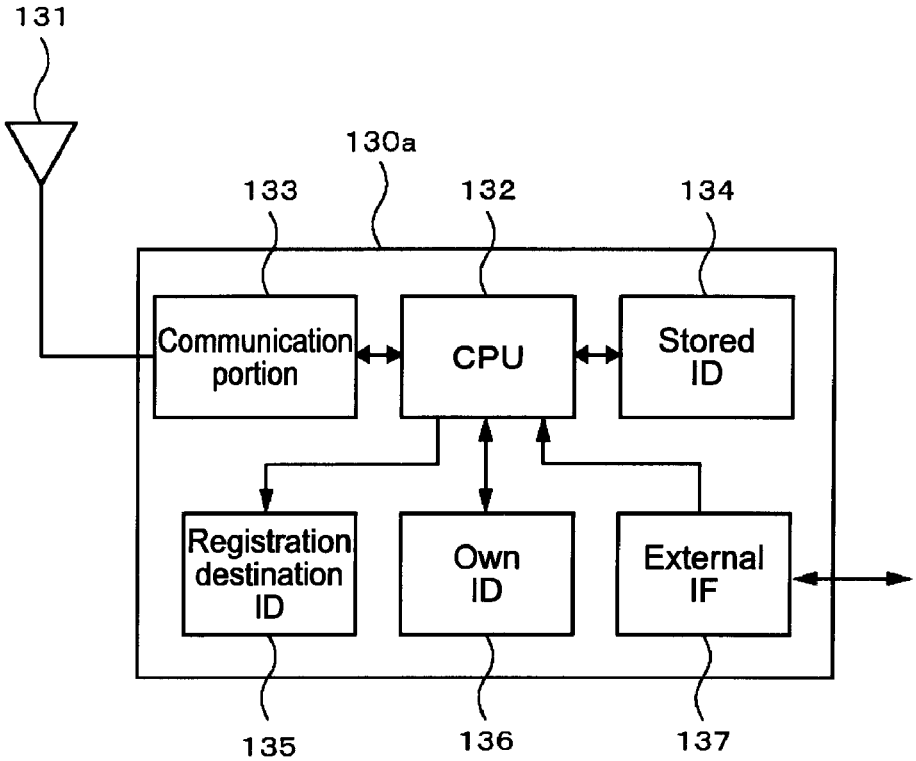

The reception modules 130*a* and 130*b* of a remote control system are respectively provided in the display unit 100 and the media receiver unit 200. As shown in FIG. 2B, the reception module 130*a* (reception module 130*b* has same structure as reception module 130*a*) includes an antenna 131 for transmitting and receiving wireless radio waves, a CPU 132 for causing a communication function, a read/write operation with respect to a storage medium, and programs corresponding to various key inputs to operate, a communication portion 133 for performing wireless communication, a storage medium 136 for storing its own ID such as EUI64, and an external interface 137 as an interface between the reception module 130*a* and the controller of the display unit 100. The CPU 132 collectively controls the respective portions of the reception module 130*a*.

Moreover, the reception modules 130*a* and 130*b* each include a storage medium 134 in which an ID of a pairing counterpart (connection destination remote controller) 120, that is, a unique ID (EUI64) is written in advance.

The communication portion 123 of the remote controller 120 and the communication portion 133 of the reception module 130*a* perform bidirectional communication using a predetermined wireless communication system. It should be noted that the communication portions 123 and 133 each have a function of outputting a command received via wireless remote control to the controller of the display unit 100 connected to the external interface 137.

The communication portion 123 of the remote controller 120 and the communication portion 133 of the reception module 130*a* are capable of performing bidirectional wireless communication using the same wireless communication system. As the wireless communication system, a physical layer of IEEE 802.15.4 can be used, for example. The IEEE 802.15.4 is a name of a short-range wireless network standard called PAN (Personal Area Network) or WPAN (Wireless Personal Area Network). A communication rate of this standard is several-ten k to several-hundred kbps, and a communication distance is several-ten m to several-hundred m. Moreover, communication is performed in a frame unit. A size of one frame is 133 bytes at maximum with a payload (0 to 127 bytes) and a header (6 bytes).

In the communication system, transmission and reception methods may take a plurality of forms. In the case of the remote control system in this embodiment, a simplest method is used. Specifically, a method of transmitting a command from the remote controller 120 to the reception modules and receiving a response from the reception modules is adopted. The communication standard of the remote control system is a 2.4-GHz band wireless communication standard. It is also possible to transmit and receive a remote control signal by other wireless systems such as IEEE 802.11b.

(Grouping Method)

In the embodiment of the present invention, for controlling the display unit 100 and the media receiver unit 200 using the remote controller 120, grouping processing is carried out in advance. The grouping processing is processing for defining terminals that respond to a single command at the same time. Several grouping methods are described below. It should be noted that as the grouping processing, processing that is the same as wireless-LAN grouping processing of the related art can be used.

The first grouping method is carried out by a button operation. The first grouping method is executed by performing grouping by the following procedure.

(1) A grouping start button (can be shared with other button) of the remote controller 120 is pressed a certain period of time. In a case of controlling a plurality of groups with a single remote controller, the button is differed for each group.
(2) A button (GUI (Graphical User Interface) is also possible) of an apparatus (display unit 100 and media receiver unit 200) to be grouped is pressed within a certain period of time since the action of (1).
(3) A signal for searching for a remote controller is output from the apparatus side. The remote controller 120 responds to the signal and exchanges group information.
(4) When the number of apparatuses that have carried out the operation of (2) within a certain period of time since the processing of (1) is 1, grouping normal-end processing is carried out (grouping completion). When the number is 2 or more, processing of canceling the grouping is carried out for all terminals.

The second grouping method is carried out by a code input. The second grouping method is executed by performing grouping by the following procedure.

(1) An arbitrary code is prepared for each group in the remote controller. The arbitrary code may be attached to a main body of the remote controller in advance, described in the instructions, or displayed on a UI on the remote controller.
(2) The code of (1) is input to an apparatus to be grouped.
(3) With the processing of (2) as a trigger, communication with the remote controller is started from the apparatus side and group information is exchanged.
(4) Grouping is completed.

The third grouping method is carried out by a direct connection. The third grouping method is executed by performing grouping by the following procedure.

(1) A remote controller and apparatuses to be grouped are put in a grouping start mode by a button press.
(2) The apparatuses subjected to the processing of (1) are connected by a cable such as a USB cable, an Ethernet (registered trademark) cable, and a serial cable, or by ultra-near wireless communication.
(3) Group information is exchanged through the communication path of (2).
(4) Grouping is completed.

(Processing of Remote Controller in Button Operation)

Processing carried out in a case where a button is pressed in the remote controller 120 will be described with reference to the flowchart of FIG. 3. In Step S1, the processing is started when the button is pressed. In Step S2, a command is issued.

Figure 3:
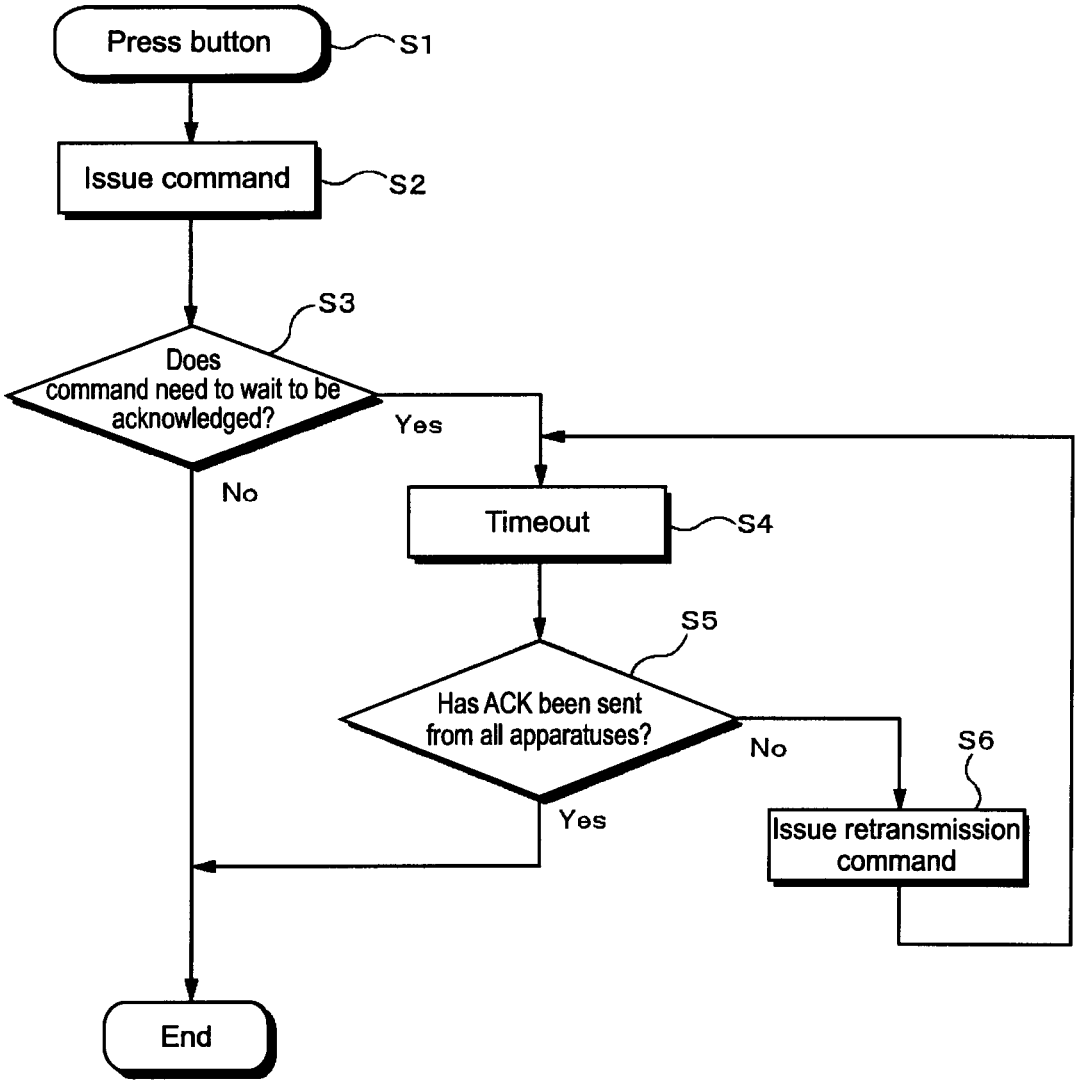
FIG. 3 is a flowchart showing a flow of processing of the remote controller according to the embodiment of the present invention.

In Step S3, it is judged whether the command is a command that needs to wait to be acknowledged (ACK in FIG. 3). When judged that the command does not need to wait to be acknowledged, the processing is ended. When judged that the command needs to wait to be acknowledged, a timeout judgment is made in Step S4.

In Step S5, it is judged whether all the grouped apparatuses have acknowledged within a set period of time. When judged that all the apparatuses have acknowledged, the processing is ended. When judged that not all the apparatuses have acknowledged, a retransmission command is issued in Step S6, and the process returns to Step S4. Then, the judgment process of Step S5 is carried out.

(Processing on Apparatus Side)

Figure 4:
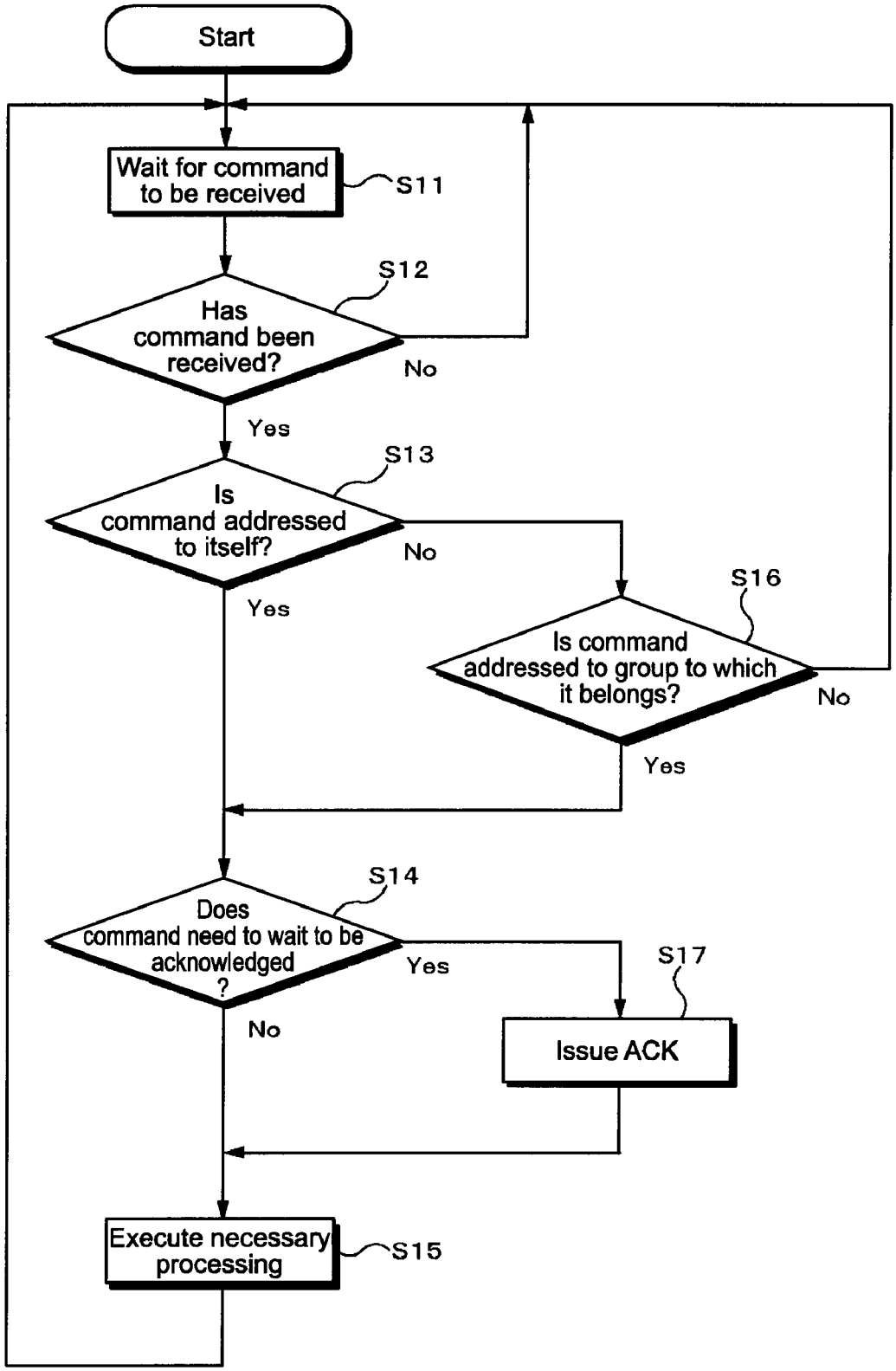
FIG. 4 is a flowchart showing a flow of processing of an apparatus according to the embodiment of the present invention.

Processing of the display unit 100 and the media receiver unit 200 will be described with reference to the flowchart of FIG. 4. In Step S11, the apparatus is waiting for a command to be received. In Step S12, it is judged whether a command has been received. When not received, the process returns to Step S11.

When judged in Step S12 that a command has been received, it is judged whether the command is addressed to itself in Step S13. When judged that the command is addressed to itself, it is judged whether the command needs to wait to be acknowledged in Step S14. When judged that the command does not need to wait to be acknowledged, necessary processing instructed by the command is executed in Step S15.

When judged that the command is not addressed to itself in Step S13, it is judged whether the command is addressed to the group to which the apparatus itself belongs in Step S16. When judged that the command is not addressed to the group to which the apparatus itself belongs, the process returns to Step S11 (to wait for command to be received). When judged that the command is addressed to the group to which the apparatus itself belongs, the process advances to Step S14 (to judge whether command needs to wait to be acknowledged).

When judged in Step S14 that the command does not need to wait to be acknowledged, necessary processing instructed by the command is executed in Step S15. When judged in Step S14 that the command needs to wait to be acknowledged, the command is acknowledged in Step S17, and the process then advances to Step S15.

(Transmission and Reception of Remote Control Signal)

Figure 5:
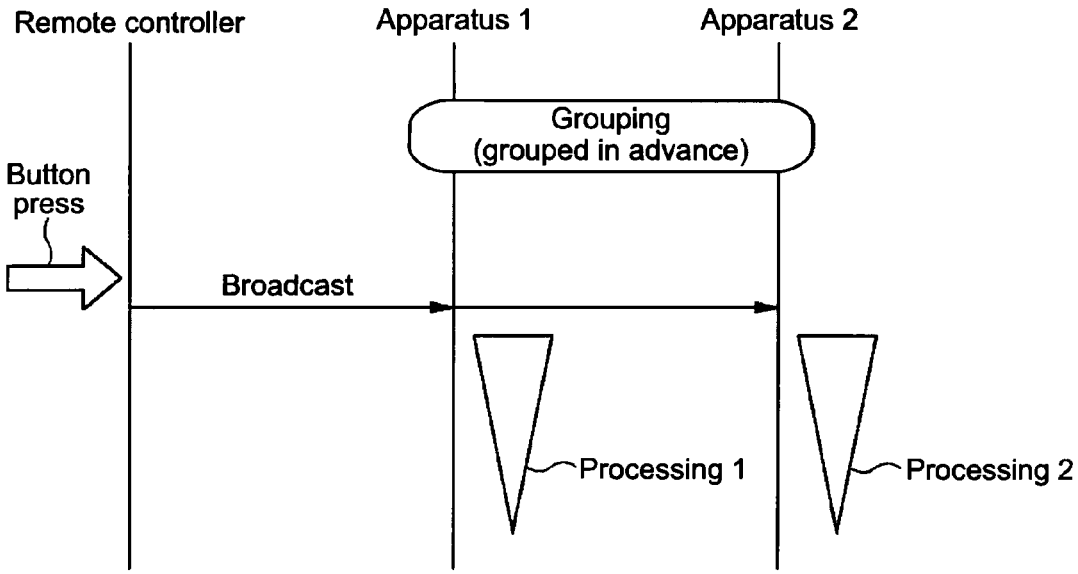
FIG. 5 is a sequence diagram for explaining communication processing in a case where an acknowledge is not used in the embodiment of the present invention.

As shown in FIG. 5, regarding an apparatus 1 (e.g., display unit 100) and an apparatus 2 (e.g., media receiver unit 200), grouping processing is carried out in advance by the methods as described above. When a button of the remote controller 120 is pressed, a remote control signal including a command corresponding to the pressed button is broadcasted.

The apparatus 1 receives the command and executes processing 1, whereas the apparatus 2 receives the command and executes processing 2. The processing sequence shown in FIG. 5 is for executing processing without the apparatus transmitting an acknowledge ACK. For example, when the command instructs power ON, power of the apparatuses 1 and 2 are turned on at the same time.

Figure 6:
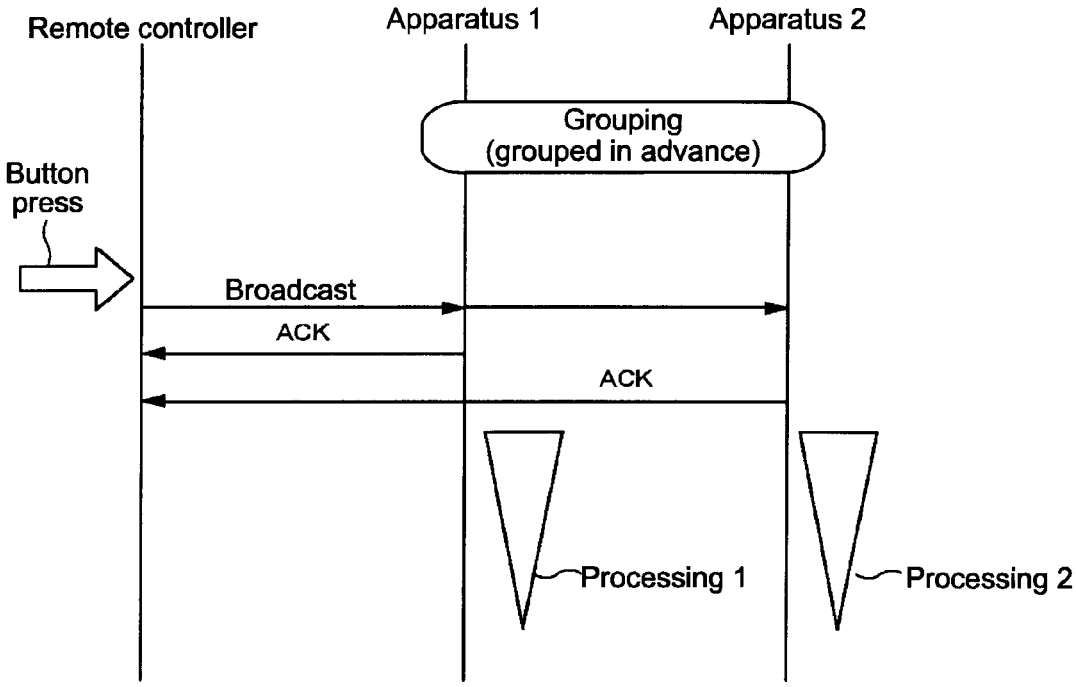
FIG. 6 is a sequence diagram for explaining communication processing in a case where an acknowledge is used in the embodiment of the present invention.

As shown in FIG. 6, it is also possible for the apparatuses 1 and 2 to transmit an acknowledge ACK for notifying the remote controller that the broadcasted command has been received normally.

Figure 7:
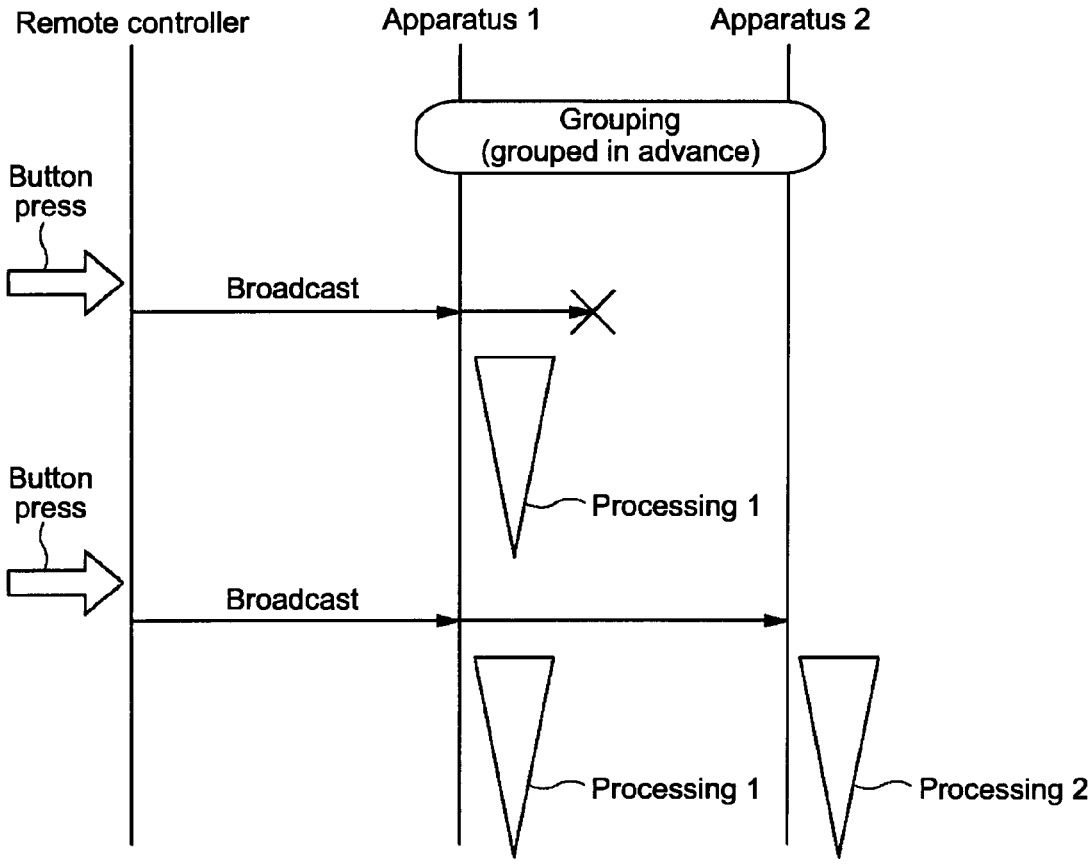
FIG. 7 is a sequence diagram for explaining communication processing at a time an error has occurred in the case where an acknowledge is not used in the embodiment of the present invention.

As shown in FIG. 7, there is a case where the broadcasted command has been received by the apparatus 1, but the apparatus 2 is unable to receive the command in the sequence of FIG. 5. Since the apparatus 2 does not carry out a desired operation in accordance with the button press of the remote controller, the user re-presses the button so that a command is broadcasted again. The example of FIG. 7 shows a case where a remote control signal transmitted for the second time is received by the apparatus 2.

In the example of FIG. 7, a command corresponding to the first button press operation is received normally by the apparatus 1, and the processing 1 is thus executed. Since a command corresponding to the second button press operation is received normally by the apparatus 2, the apparatus 2 executes the processing 2. The apparatus 1 is capable of normally receiving a command. Whether the apparatus 1 re-executes the processing 1 is judged by the apparatus 1 based on an internal state thereof.

Figure 8:
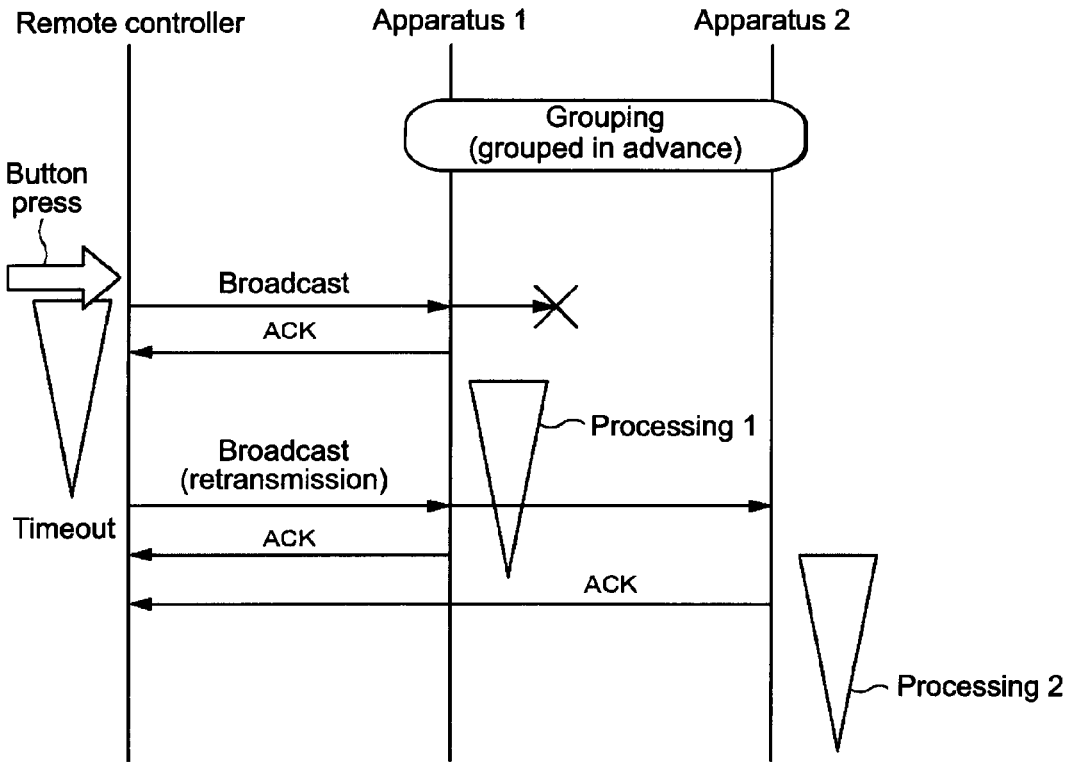
FIG. 8 is a sequence diagram for explaining communication processing at a time an error has occurred in the case where an acknowledge is used in the embodiment of the present invention.

As shown in FIG. 8, there is a case where the broadcasted command has been received by the apparatus 1, but the apparatus 2 is unable to receive the command in the sequence of FIG. 6. An acknowledge from the apparatus 1 is transmitted to the remote controller, and the processing 1 is executed. Since the apparatus 2 has not acknowledged within a set period of time, an error that a command cannot be transmitted to the apparatus 2 is detected in the remote controller.

The remote controller broadcasts the same command again. The apparatuses 1 and 2 receive the command. Since the apparatus 1 has already executed processing corresponding to the command, the apparatus 1 transmits an acknowledge to the remote controller and does not execute the processing 1. On the other hand, the apparatus 2 sends back an acknowledge and executes the processing 2.

Figure 9:
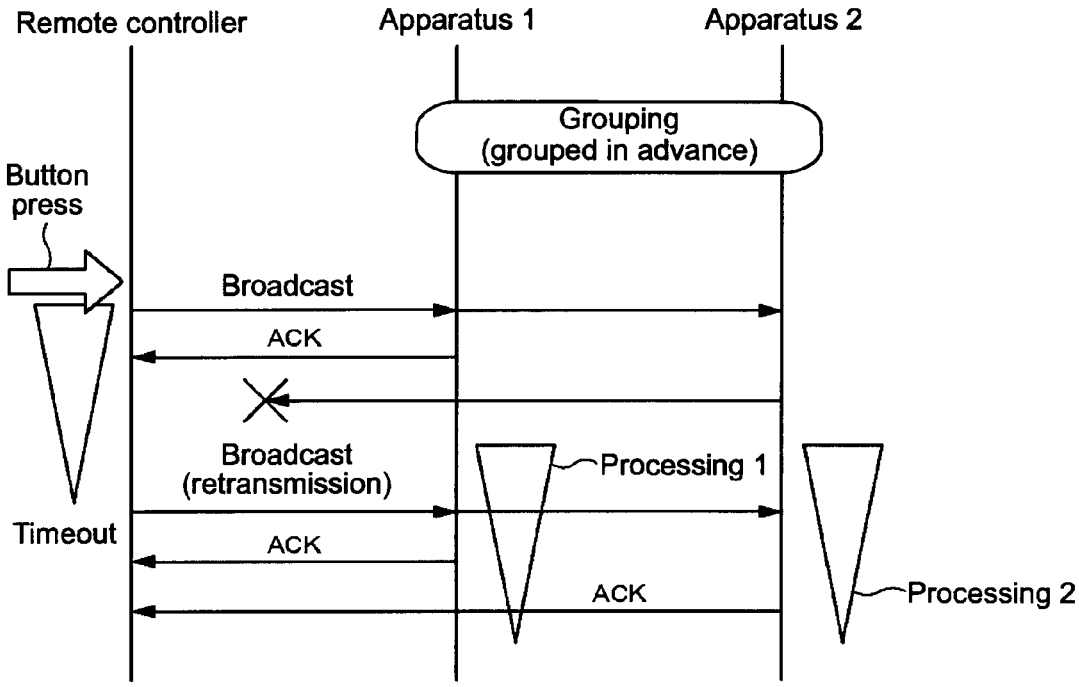
FIG. 9 is a sequence diagram for explaining another example of the communication processing at the time an error has occurred in the case where an acknowledge is used in the embodiment of the present invention.

Another example of a case where an error has occurred is shown in FIG. 9. Specifically, an error in which, although the apparatuses 1 and 2 have executed the processing 1 and the processing 2 in accordance with a command that has been broadcasted first, an acknowledge from the apparatus 2 cannot be received by the remote controller occurs. Since the remote controller has been unable to receive the acknowledge, a command is retransmitted. The apparatuses 1 and 2 receive the command normally and send back an acknowledge. Since the processing 1 and the processing 2 have already been executed in accordance with the command that has been received first, the acknowledge is merely sent back, and the processing is not executed repetitively.

The present invention is not limited to the above embodiment, and various modifications can be made based on the technical idea of the present invention. For example, it is also possible to group remote control of video recorders connected to the media receiver unit and turn on a power source of the video recorders when a power-ON command is issued by the remote controller. In addition, power OFF may also be controlled.

The present application contains subject matter related to that disclosed in Japanese Priority Patent Application JP 2009-061204 filed in the Japan Patent Office on Mar. 13, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A remote control method, comprising:

grouping a plurality of apparatuses to respond to a command from a single remote controller at the same time;

receiving input from a user including a command, the command corresponding to an operation;

broadcasting, by the remote controller, the command to a group of apparatuses identified by the grouping step;

receiving, by each of the plurality of apparatuses, the command and judging whether the received command is addressed to a group to which the apparatus itself belongs; and executing, when it is judged by each of the plurality of apparatuses that the received command is addressed to the group to which the apparatus itself belongs, processing corresponding to the command.

2. The remote control method according to claim 1, wherein the command transmitted from the remote controller is a command that controls ON/OFF of a power source.

3. The remote control method according to claim 1, further comprising:

judging, when it is judged by each of the plurality of apparatuses that the command is addressed to the apparatus itself, whether the command is waiting to be acknowledged; and acknowledging the command when it is judged that the command is waiting to be acknowledged.

4. A remote control system, comprising:

a single remote controller including:

an operation portion that receives input from a user including a command corresponding to an operation; and a communication portion that broadcasts the command to a previously defined group of apparatuses; and a plurality of apparatuses grouped to respond to the command from the remote controller at the same time, each of the plurality of apparatuses including a reception judgment portion that receives the command and judges whether the received command is addressed to a group to which the apparatus itself belongs and a controller that executes, when it is judged that the received command is addressed to the group to which the apparatus itself belongs, processing corresponding to the command.

5. The remote control system according to claim 4, wherein the command transmitted from the remote controller is a command that controls ON/OFF of a power source.

6. The remote control system according to claim 4, wherein each of the plurality of apparatuses judges, when it is judged that the command is addressed to the apparatus itself, whether the command is waiting to be acknowledged and acknowledges the command when it is judged that the command is waiting to be acknowledged.

7. The remote control method according to claim 1, wherein broadcasting further comprises transmitting destination information, the destination information including identification information of each of the plurality of apparatuses in the group, or identification information of the group identified by the grouping step.

8. The remote control method according to claim 1, wherein grouping the plurality of apparatuses comprises pressing buttons representing each apparatus to be grouped on the remote controller.

9. The remote control method according to claim 1, wherein grouping the plurality of apparatuses comprises displaying a code representing a group on the remote controller, and inputting the code into each apparatus in the group.

10. The remote control method according to claim 1, wherein grouping the plurality of apparatuses comprises connecting the remote controller to each apparatus to be grouped by wired or wireless communication, and exchanging group information.

11. The remote control system according to claim 4, wherein the communication portion further broadcasts destination information, the destination information including the identification information of each of the plurality of apparatuses in the group, or the identification information of the group identified by the grouping step.

* * * * *